US009159538B1

(12) United States Patent
McClure et al.

(10) Patent No.: US 9,159,538 B1
(45) Date of Patent: Oct. 13, 2015

(54) USE OF MASS SPECTRAL DIFFERENCE NETWORKS FOR DETERMINING CHARGE STATE, ADDUCTION, NEUTRAL LOSS AND POLYMERIZATION

(71) Applicant: Thermo Finnigan LLC, San Jose, CA (US)

(72) Inventors: Thomas McClure, Sunnyvale, CA (US); Michael J. Athanas, San Jose, CA (US); Matthew Kump, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/302,304

(22) Filed: Jun. 11, 2014

(51) Int. Cl.
*H01J 49/00* (2006.01)
*H01J 49/26* (2006.01)
*H01J 49/02* (2006.01)

(52) U.S. Cl.
CPC ..... *H01J 49/0036* (2013.01); *H01J 49/022* (2013.01); *H01J 49/26* (2013.01)

(58) Field of Classification Search
CPC ..... H01J 49/0036; H01J 49/26
See application file for complete search history.

(56) References Cited

U.S. PATENT DOCUMENTS

| | | | | |
|---|---|---|---|---|
| 2003/0109990 | A1* | 6/2003 | Axelsson | 702/27 |
| 2006/0121618 | A1* | 6/2006 | Shilov et al. | 436/86 |
| 2007/0284520 | A1* | 12/2007 | Yamamoto | 250/282 |
| 2008/0048110 | A1* | 2/2008 | Deguchi et al. | 250/282 |
| 2008/0070314 | A1* | 3/2008 | Geromanos et al. | 436/86 |
| 2009/0026360 | A1* | 1/2009 | Yamauchi et al. | 250/281 |
| 2009/0076737 | A1* | 3/2009 | Wang et al. | 702/23 |
| 2010/0114498 | A1* | 5/2010 | Park | 702/19 |
| 2012/0049058 | A1* | 3/2012 | Grothe, Jr. | 250/282 |
| 2013/0110412 | A1* | 5/2013 | Valkenborg et al. | 702/23 |
| 2014/0087408 | A1* | 3/2014 | Murayama et al. | 435/23 |
| 2014/0088885 | A1* | 3/2014 | Lee | 702/25 |
| 2014/0252218 | A1* | 9/2014 | Wright et al. | 250/282 |
| 2014/0297201 | A1* | 10/2014 | Knorr et al. | 702/28 |

* cited by examiner

*Primary Examiner* — Michael Logie
(74) *Attorney, Agent, or Firm* — Thomas F. Cooney

(57) ABSTRACT

A mass spectrometric analysis method comprises: (1) processing a mass spectrum to reduce the signals to monoisotopic values; (2) creating a list of differences between the monoisotopic values; (3) creating one or more lists of theoretical mass-to-charge differences among known adducts, charge states and polymerization states whose formation may be expected from various analyte molecules; (4) comparing the theoretical differences (line or edge in the network) to the list of differences from the mass spectrum and, where applicable, make and tabulate tentative species assignments; and (5) assigning the mass spectral peaks to respective ion species in accordance with the redundancy of each assignment based on multiple independent calculated mass-to-charge differences pertaining to each peak.

8 Claims, 6 Drawing Sheets

USE OF MASS SPECTRAL DIFFERENCE NETWORKS FOR DETERMINING CHARGE STATE, ADDUCTION, NEUTRAL LOSS AND POLYMERIZATION

FIELD OF THE INVENTION

This invention relates to methods of analyzing data obtained from instrumental analysis techniques used in analytical chemistry and, in particular, to methods of automatically identifying molecular compounds through the recognition of mass spectral patterns relating to the protonated or adducted molecules, any molecules gaining or losing species, or polymers of the molecules.

BACKGROUND OF THE INVENTION

Mass spectrometry (MS) is an analytical technique to filter, detect, identify and/or measure compounds by the mass-to-charge ratios of ions formed from the compounds. The quantity of mass-to-charge ratio is commonly denoted by the symbol "m/z" in which "m" is ionic mass in units of Daltons and "z" is ionic charge in units of elementary charge, e. Thus, mass-to-charge ratios are appropriately measured in units of "Da/e". Mass spectrometry techniques generally include (1) ionization of compounds and optional fragmentation of the resulting ions so as to form fragment ions; and (2) detection and analysis of the mass-to-charge ratios of the ions and/or fragment ions and calculation of corresponding ionic masses. The compound may be ionized and detected by any suitable means. A "mass spectrometer" generally includes an ionizer and an ion detector.

The hybrid technique of liquid chromatography-mass spectrometry (LC/MS) is an extremely useful technique for detection, identification and (or) quantification of components of mixtures or of analytes within mixtures. This technique generally provides data in the form of a mass chromatogram, in which detected ion intensity (a measure of the number of detected ions) as measured by a mass spectrometer is given as a function of time. In the LC/MS technique, various separated chemical constituents elute from a chromatographic column as a function of time. As these constituents come off the column, they are submitted for mass analysis by a mass spectrometer. The mass spectrometer accordingly generates, in real time, detected relative ion abundance data for ions produced from each eluting analyte, in turn. Thus, such data is inherently three-dimensional, comprising the two independent variables of time and mass (more specifically, a mass-related variable, such as mass-to-charge ratio) and a measured dependent variable relating to ion abundance. The term "liquid chromatography" includes, without limitation, reverse phase liquid chromatography (RPLC), hydrophilic interaction liquid chromatography (HILIC), high performance liquid chromatography (HPLC), ultra high performance liquid chromatography (UHPLC), normal-phase high performance liquid chromatography (NP-HPLC), supercritical fluid chromatography (SFC) and ion chromatography.

Conventionally, one can often enhance the resolution of the MS technique by employing "tandem mass spectrometry" or "MS/MS", via use, for example, of a triple quadrupole mass spectrometer. In this technique, a first (or parent or precursor) ion species generated from a molecular species of interest can be filtered or isolated in an MS instrument. The precursor ions of the various precursor ion species can be subsequently fragmented to yield one or more second (or product or fragment) ions comprising various product/fragment ion species that are then analyzed in a second MS stage. By careful selection of precursor ion species, only ions produced by certain analytes are passed to the fragmentation chamber or other reaction cell, such as a collision cell where collision of ions with atoms of an inert gas produces the product ions.

Typically, mass spectral experiments that survey for the presence of multiple analytes using the MS/MS technique rely on automatic data-dependent decision logic. Data-dependent acquisition involves using data derived from an experimentally-acquired mass spectrum in an "on-the-fly" manner to direct the subsequent operation of a mass spectrometer; for example, a mass spectrometer may be switched between MS and MS/MS scan modes upon detection of an ion species of potential interest. Utilization of data-dependent acquisition methods in a mass spectrometer provides the ability to make automated, real-time decisions in order to maximize the useful information content of the acquired data.

More generally, data-dependent acquisition methods may be characterized as having one or more input criteria, and one or more output actions. The input criteria employed for conventional data-dependent methods are generally based on parameters such as intensity, intensity pattern, mass window, mass difference (neutral loss), mass-to-charge (m/z) inclusion and exclusion lists, and product ion mass. The input criteria are employed to select one or more ion species that satisfy the criteria. The selected ion species are then subjected to an output action (examples of which include performing MS/MS or $MS^n$ analysis and/or high-resolution scanning).

Unfortunately, the identification of compounds by either the MS or MS/MS technique may, in practice, be complicated by the fact that any single chemical compound can give rise to many mass spectral ionic species in a typical LC-MS analysis. The multiple mass spectral species result from the formation of more than one adducted and polymer ion species from each compound. Additionally, each such ion species will generally give rise to multiple mass spectral peaks because of the presence of multiple isotopes of various constituent elements as well as the existence of polymerization and multiple charge states. Adduction of the molecule being analyzed can involve combinations of various additions or losses of charged (e.g. $H^+$, $Na^+$, $NH4^+$, $K^+$, . . . ) and neutral ($H_2O$, MeOH, ACN, . . . ) atom groups. Typically, determination of adducts and polymers and, to a lesser extent, charge states of small molecules requires the assignment of the monoisotopic $(M+H)^+$ or $(M-H)^-$ species for which then differences to other species are calculated and determined. Failure to properly recognize or account for multiple related mass spectral peaks resulting from a single compound may cause undesirable false positive identifications of certain analytes or lead to incorrect selection of precursor ions during a data-dependent decision step of an MS/MS analysis.

SUMMARY

In order to address the above-noted difficulties, this disclosure describes the use of so-called "difference networks" to predict charge states, degree of polymerization and the types and number of adducts that may be found in a component ionic species. According to the novel methods described herein, the differences between mass-to-charge ratios of monoisotopic species are calculated and used to make such predictions for various anticipated analyte species. The calculated difference networks are then compared monoisotopic mass-to-charge differences calculated from an experimental mass spectrum and the comparisons used to assign observed peaks to individual ion species and to correlate groups of related peaks. The novel techniques thus include generating a collection of differences between each of the species (molecule±adduct±charge carrier) to which are assigned adduct(s), charge states and polymerization states. The mass spectrum is then scanned for these differences. Once a set of such differences are found in the mass spectrum, the hypothetical species are then assigned to the peaks. Because any mass spectrum will generally include many peaks whose m/z values may be compared to one another, any particular peak can have many such assignments. However, a high frequency of duplicate assignments for any peak adds confidence in the accuracy of that specific assignment. Thus, the final species assignments are chosen as those that have the greatest number of confirmatory assignments. These assignments are important for component detection by grouping signals that derive from a common chemical compound. Proper grouping in component detection reduces the overall complexity and confusion over false positive signals.

An exemplary method of mass spectral analysis in accordance with the present teachings comprises: identifying isotopic clusters in mass spectral data; determining a respective monoisotopic (m/z) value for each identified cluster; calculating theoretical monoisotopic m/z values of theoretically predicted ion species, each species corresponding to a respective combination of analyte-molecule composition, adduction, ionic charge state, and analyte-molecule polymerization state; calculating a $\Delta(m/z)_{exp}$ value corresponding to the difference between the m/z values of each respective pair of determined experimental monoisotopic m/z values; calculating a $\Delta(m/z)_{theor}$ value corresponding to the difference between the m/z values of each respective pair of calculated theoretical monoisotopic m/z values; and assigning, to the respective pair of ion species corresponding to each pair of experimental monoisotopic m/z values for which $\Delta(m/z)_{exp}$ is equal to a matching $\Delta(m/z)_{theor}$ within a predetermined tolerance, combinations of adduction, ionic charge state, and analyte-molecule polymerization state corresponding to the matching pair of theoretically-predicted ion species.

In various embodiments, methods may further comprise: receiving, from a mass spectrometer, the experimentally observed mass spectral data prior to performing the step (a) identifying isotopic clusters; choosing an ion species for further fragmentation or reaction in the mass spectrometer, wherein the choice of ion species is based on the assigning; and performing the fragmentation or reaction on the chosen ion species in the mass spectrometer. In various embodiments, methods may further comprise the steps of: tabulating, for each ion species corresponding to a determined experimental monoisotopic m/z value, the total number of times that each combination of adduction, neutral loss, ionic charge state, and analyte-molecule polymerization state has been assigned to the ion species; and choosing, as a final assignment for each ion species, the particular combination of adduction, ionic charge state, and analyte-molecule polymerization state that has been assigned to the respective ion species the greatest number of times. In various embodiments, the experimentally observed mass spectral data may be received directly from a mass spectrometer, wherein the mass spectrometer continues to operate simultaneously with the execution of the above noted steps. The results of the assigning step may be reported to a user or stored in or on an electronic storage medium. Additionally, or alternatively, the results of the assigning step may be employed to specifically choose parameters relating to subsequent operation of the mass spectrometer, such as choosing a particular ionic m/z value for subsequent processing.

BRIEF DESCRIPTION OF THE DRAWINGS

The above noted and various other aspects of the present invention will become apparent from the following description which is given by way of example only and with reference to the accompanying drawings, not drawn to scale, in which.

DETAILED DESCRIPTION

The present invention provides methods and apparatus for determining and assigning charge states, adducts and polymerization states of mass spectral peaks and correlating specific sets of the peaks with a particular analyte molecules. The automated methods and apparatus described herein do not require any user input or intervention. The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the appended FIGS. 1-6, taken in conjunction with the following description.

1.0. Instrumentation

Figure 1:
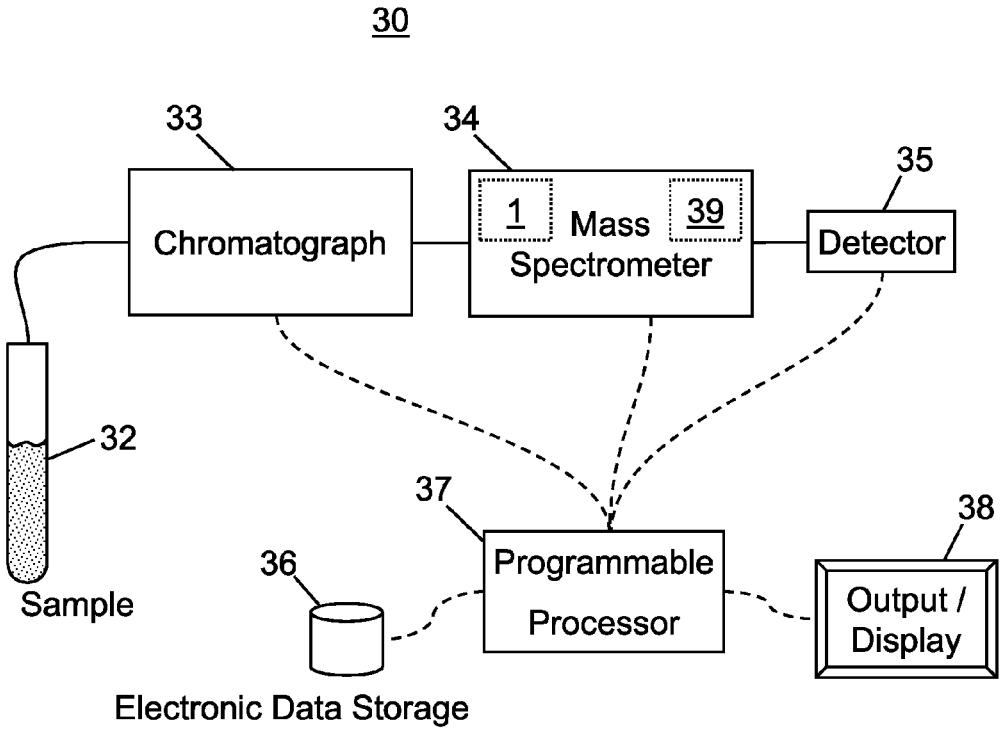
FIG. 1 (Prior Art)
FIG. 1 is a schematic diagram of a system for generating chromatography/mass spectrometry spectra and automatically analyzing the spectra in accordance with the present teachings.

FIG. 1 is a schematic diagram of a general system 30 for generating and automatically analyzing chromatography/mass spectrometry spectra in accordance with the present teachings. A chromatograph 33, such as a liquid chromatograph, high-performance liquid chromatograph or ultra high performance liquid chromatograph or other type of chromatograph receives a sample 32 of an analyte mixture and at least partially separates the analyte mixture into individual chemical constituents, in accordance with well-known chromatographic principles. As a result, the at least partially separated chemical constituents are transferred to a mass spectrometer 34 at different respective times for mass analysis. As each chemical constituent is received by the mass spectrometer, it is ionized by an ionization source 1 of the mass spectrometer. The ionization source 1 may produce a plurality of ions (i.e., a plurality of precursor ions) comprising differing charges or masses from each chemical component. Thus, a plurality of ion species of differing mass-to-charge ratios may be produced for each chemical component, each such component eluting from the chromatograph at its own characteristic time. These various ion species are analyzed and detected by the mass spectrometer together with its detector 35 and, as a result, appropriately identified according to their various mass-to-charge ratios. As illustrated in FIG. 1, the mass spectrometer comprises a reaction cell 39 to fragment or cause other reactions of the precursor ions.

Figure 2:
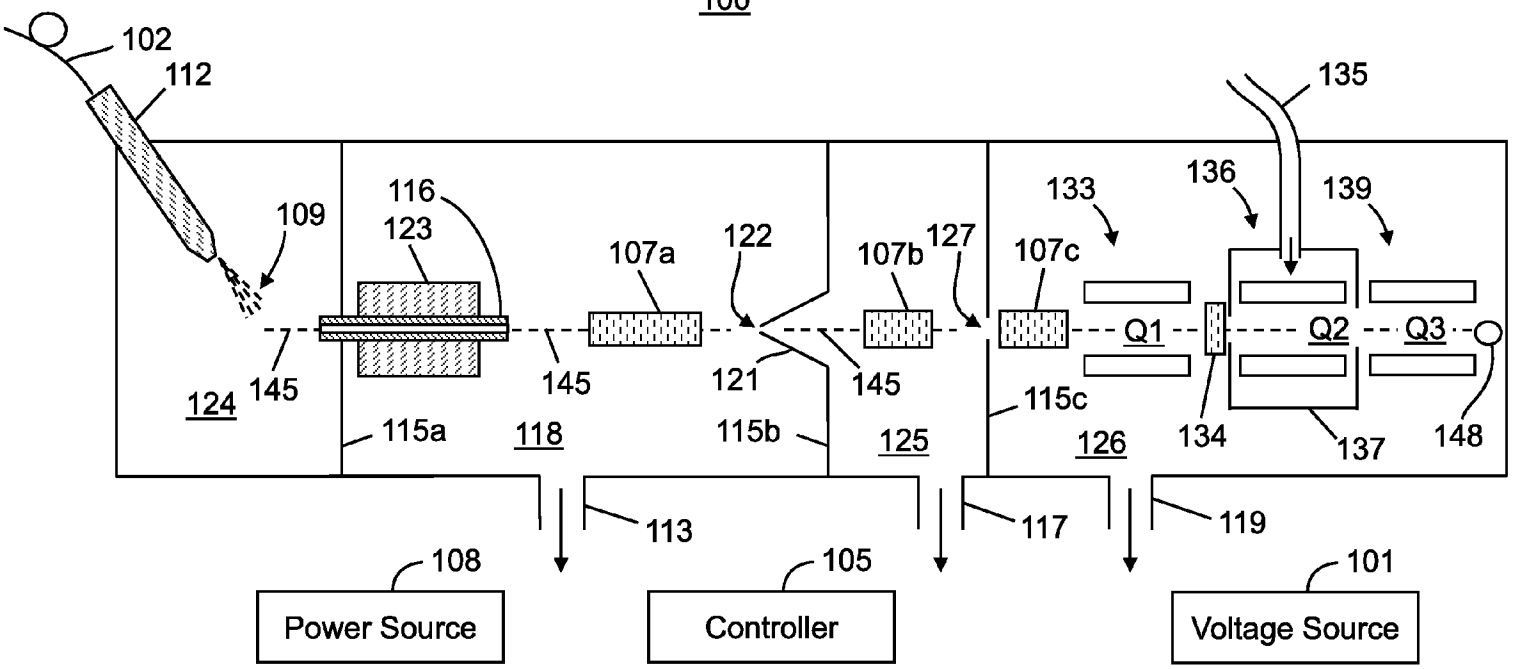
FIG. 2 (Prior Art)
FIG. 2 is a schematic illustration of one specific example of a mass spectrometer system which may be employed in the practice of the present teachings, wherein the mass spectrometer comprises a triple quadrupole mass spectrometer.

FIG. 2 is a schematic illustration of an example of a conventional mass spectrometer system 100 capable of performing tandem mass spectrometry. As illustrated in FIG. 2, the mass spectrometer system 100 is a triple-quadrupole system comprising a first quadrupole device 133, a second quadrupole device 136 and a third quadrupole device 139, the last of which is a mass analyzer comprising one or more ion detectors 148. The first, second and third quadrupole devices may be denoted as, using common terminology, as Q1, Q2 and Q3, respectively.

The mass spectrometer system 100 comprises an electrospray ion source (ESI) 112 housed in an ionization chamber 124. The ESI source 112 is connected so as to receive a liquid comprising analyte compounds from a chromatography system (not shown) through fluid tubing line 102. As but one example, an atmospheric pressure electrospray source is illustrated. The electrospray ion source 112 forms charged particles 109 (either free ions or charged liquid droplets that may be desolvated so as to release ions) representative of the sample. The emitted droplets or ions are entrained in a background or sheath gas that serves to desolvate the droplets as well as to carry the charged particles into a first intermediate-pressure chamber 118 which is maintained at a lower pressure than the pressure of the ionization chamber 124 but at a higher pressure than the downstream chambers of the mass spectrometer system. The ion source 112 may be provided as a "heated electrospray" (H-ESI) ion source comprising a heater that heats the sheath gas that surrounds the droplets so as to provide more efficient desolvation. The charged particles may be transported through an ion transfer tube 116 that passes through a first partition element or wall 115*a* into the first intermediate-pressure chamber 118. The ion transfer tube 116 may be physically coupled to a heating element or block 123 that provides heat to the gas and entrained particles in the ion transfer tube so as to aid in desolvation of charged droplets so as to thereby release free ions.

The free ions are subsequently transported through the intermediate-pressure chambers 118 and 125 of successively lower pressure in the direction of ion travel. A second plate or partition element or wall 115*b* separates the first intermediate-pressure chamber 118 from the second intermediate-pressure chamber 125. Likewise, a third plate or partition element or wall 115*c* separates the second intermediate-pressure region 125 from the high-vacuum chamber 126 that houses a mass analyzer 139 component of the mass spectrometer system. A first ion optical assembly 107*a* provides an electric field that guides and focuses the ion stream leaving ion transfer tube 116 through an aperture 122 in the second partition element or wall 115*b* that may be an aperture of a skimmer 121. A second ion optical assembly 107*b* may be provided so as to transfer or guide ions to an aperture 127 in the third plate or partition element or wall 115*c* and, similarly, another ion optical assembly 107*c* may be provided in the high vacuum chamber 126 containing a mass analyzer 139. The ion optical assemblies or lenses 107*a*-107*c* may comprise transfer elements, such as, for instance a multipole ion guide, so as to direct the ions through aperture 122 and into the mass analyzer 139. The mass analyzer 139 comprises one or more detectors 148 whose output can be displayed as a mass spectrum. Vacuum ports 113, 117 and 119 may be used for evacuation of the various vacuum chambers.

The mass spectrometer system 100 is in electronic communication with a programmable processor 105 or other electronic controller which includes hardware and/or software logic for performing data analysis and control functions. Such programmable processor may be implemented in any suitable form, such as one or a combination of specialized or general purpose processors, field-programmable gate arrays, and application-specific circuitry. In operation, the programmable processor effects desired functions of the mass spectrometer system (e.g., analytical scans, isolation, and dissociation) by adjusting voltages (for instance, RF, DC and AC voltages) applied to the various electrodes of ion optical assemblies 107*a*-107*c* and quadrupoles or mass analyzers 133, 136 and 139, and also receives and processes signals from detectors 148. The programmable processor 105 may be additionally configured to store and run data-dependent methods in which output actions are selected and executed in real time based on the application of input criteria to the acquired mass spectral data. The data-dependent methods, as well as the other control and data analysis functions, will typically be encoded in software or firmware instructions executed by programmable processor. A power source 108 supplies an RF voltage to electrodes of the devices and a voltage source 101 is configured to supply DC voltages to predetermined devices.

A lens stack 134 disposed at the ion entrance to the second quadrupole device 136 may be used to provide a first voltage point along the ions' path. The lens stack 134 may be used in conjunction with ion optical elements along the path after stack 134 to impart additional kinetic energy to the ions. The additional kinetic energy is utilized in order to effect collisions between ions and neutral gas molecules within the second quadrupole device 136. If collisions are desired, the voltage of all ion optical elements (not shown) after lens stack 134 are lowered relative to lens stack 134 so as to provide a potential energy difference which imparts the necessary kinetic energy.

Various modes of operation of the triple quadrupole system 100 are known. In some modes of operation, the first quadrupole device is operated as an ion trap which is capable of retaining and isolating selected precursor ions (that is, ions of a certain mass-to-charge ratio, m/z) which are then transported to the second quadrupole device 136. More commonly, the first quadrupole device may be operated as a mass filter such that only ions having a certain restricted range of mass-to-charge ratios are transmitted therethrough while ions having other mass-to-charge ratios are ejected away from the ion path 145. In many modes of operation, the second quadrupole device is employed as a fragmentation device or collision cell which causes collision induced fragmentation of precursor ions through interaction with molecules of an inert collision gas introduced through tube 135 into a collision cell chamber 137. The second quadrupole 136 may be operated as an RF-only device which functions as an ion transmission device for a broad range of mass-to-charge ratios. In an alternative mode of operation, the second quadrupole may be operated as a second ion trap. The precursor and/or fragment ions are transmitted from the second quadrupole device 136 to the third quadrupole device 139 for mass analysis of the various ions.

2.0. Methods of Making Mass Spectral Assignments

Figure 3:
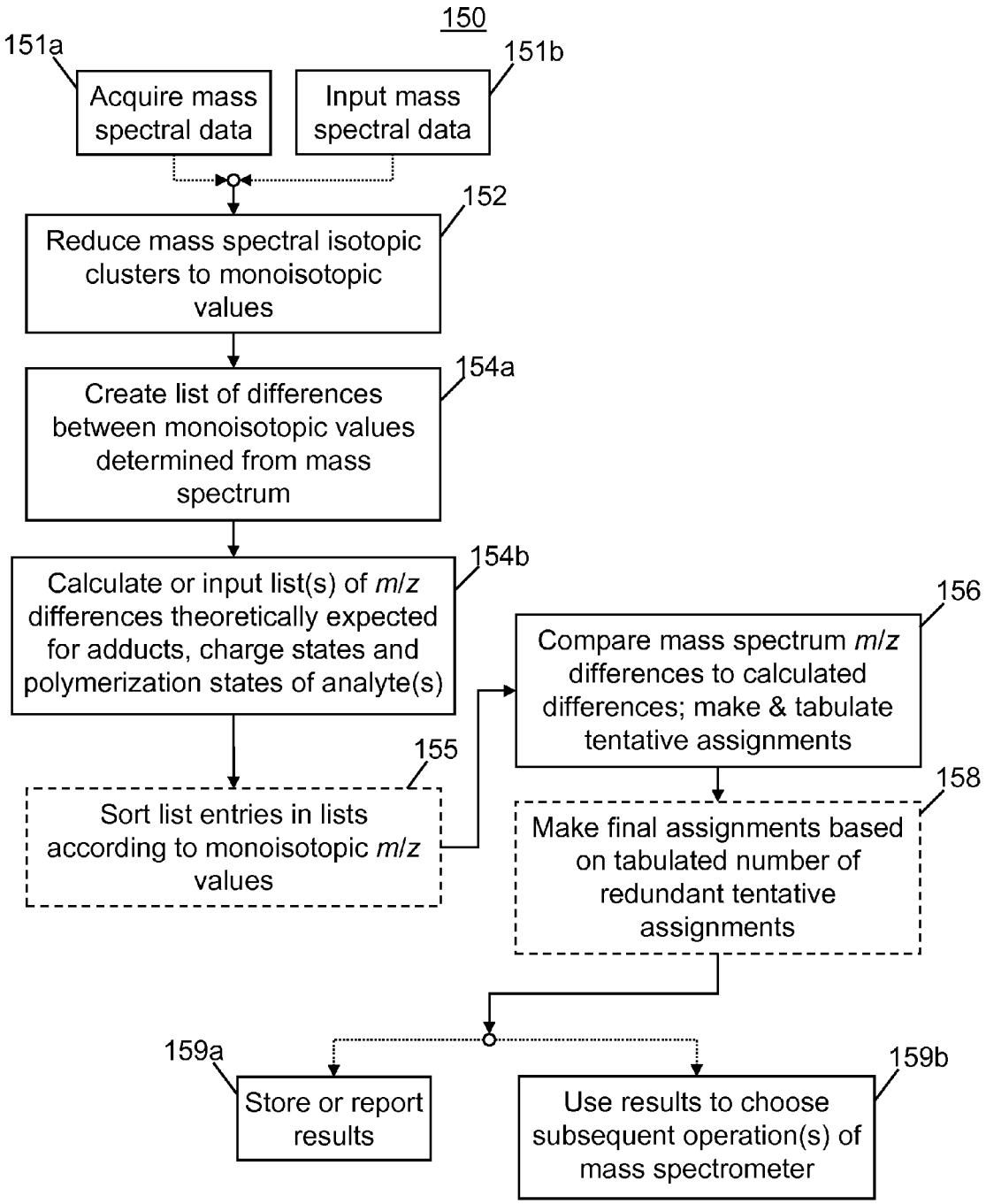
FIG. 3 is a flowchart of a generalized method, in accordance with the present teachings, for determining charge states, adducts and polymerization states of mass spectral peaks and correlating specific sets of the peaks with a particular analyte.

FIG. 3 is a flow diagram of a method, in accordance with the present teachings, for determining charge states, adducts and polymerization states of mass spectral peaks and correlating specific sets of the peaks with a particular analyte. The reader is referred to the steps of the method 150 shown in FIG. 3 in relation to the discussion in the following sections 2.1 through 2.4. The initial steps 151*a* and 151*b* represent two mutually alternative means for inputting experimental data that will be processed by subsequent steps of the method 150. The pathway that employs step 151*a* may be considered to comprise "online" data processing whereas the pathway that employs the alternative step 151*b* may be considered to comprise "offline" data processing.

Using the pathway through step 151*a*, data is acquired by a mass spectrometer 34 (FIG. 1) and at least part of the data is stored in electronic memory of the programmable processor 37 which processes the data by executing subsequent steps of the method 150 simultaneously with continued operation of the mass spectrometer 34. For example, the subsequent steps 152-159*a* (or, alternatively, 152-159*b*) may rely on and make use of data obtained from a single mass spectrum (sometimes referred to as a "scan" for mass spectra obtained with scanning-type instruments). However, the continued operation of the chromatograph 33 during a single experiment may continuously supply eluate of varying chemical composition to the mass spectrometer which must continuously generate a series of mass spectra. In this example, the analytical operations of method 150 may be performed on data derived from one such mass spectrum at the same time that data of another mass spectrum is being generated. By contrast, if the execution pathway begins at step 151*b*, then previously acquired and stored data is analyzed after the acquisition of a complete set of LCMS data from a single experiment. In this case, the automatic processor that performs steps 152-159*a* (or, alternatively, 152-159*b*) may be different from the programmable processor 37 that is electronically coupled to the mass spectrometer.

2.1. Calculation of Monoisotopic Mass-to-Charge Values

The step 152, of the method 150 shown in FIG. 3 includes identifying peaks corresponding to isotopic clusters in the mass spectrum and reducing each such isotopic cluster to its respective monoisotopic m/z value. Any suitable method of calculating monoisotopic m/z values may be employed in step 152. For example, step 152 may employ any of various known methods for calculating monoisotopic values. Some exemplary methods are described in U.S. Pat. No. 6,188,064 and in United States Patent Application Pre-Grant Publications 2003/0109990 A1, 2010/0114498 A1 and 20110282588 A1. Subsequently, in step 154*a*, all possible differences between the monoisotopic m/z values are calculated, by simple subtraction. Specifically, if there are N different calculated monoisotopic values associated with a mass spectrum, then for each such calculated monoisotopic value, $(m/z)_j$, the various quantities $\Delta(m/z)_{i-j}$ are calculated as $\Delta(m/z)_{i-j}=(m/z)_i-(m/z)_j$, $\forall j, j\neq i$. The set of results of these calculations is herein termed a mass spectral difference table.

2.2. Generating the Table of Candidate Ion Species

In step 154*b* of the method 150 (FIG. 3), a list of known adduct species is used to calculate a theoretical difference table as described below. First, a table of candidate values is created where each entry represents a specific candidate ion species, such as species having various adducts, polymerization states, or charge states and generated from a molecule or chemical group, M. The following is an example of the information contained in the table:

TABLE 1

Example of calculation of table of candidate ion species

| Name | Charge Number | Polymer Number | Adduct Total Mass | Total Mass Difference |
|---|---|---|---|---|
| [M + H] | 1 | 1 | 0 | 1.00727 |
| [M + 2H] | 2 | 1 | 0 | 2.01455 |
| [M + 3H] | 3 | 1 | 0 | 3.02183 |
| [M + 2H − H2O] | 1 | 1 | −18.01056 | 1.00727 |

TABLE 1-continued

Example of calculation of table of candidate ion species

| Name | Charge Number | Polymer Number | Adduct Total Mass | Total Mass Difference |
|---|---|---|---|---|
| [M + 2H − 2(H2O)] | 1 | 1 | −36.02113 | 1.00727 |
| [M + 2H − 3(H2O)] | 1 | 1 | −54.03169 | 1.00727 |
| [M + H + CH3CN] | 1 | 1 | 41.02655 | 1.00727 |
| ... | ... | ... | ... | ... |

The step 154*b* may be performed prior to step 154*a*. In general, the various possible types of adducts and charge carriers (such as $H^+$, $Na^+$, $NH4^+$, etc.) will be roughly similar for all or most analytes.

Figure 5:
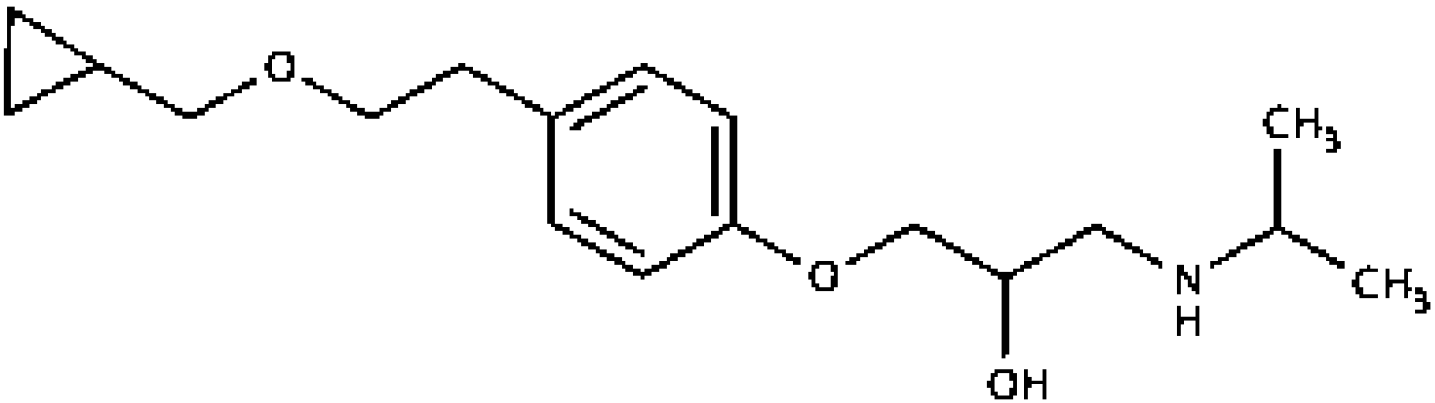
FIG. 5 is a diagram of the chemical structure of the chemical compound Betaxolol ($C_{18}H_{29}NO_3$) having a monoisotopic mass of 307.21474 a.u.
Figure 6:
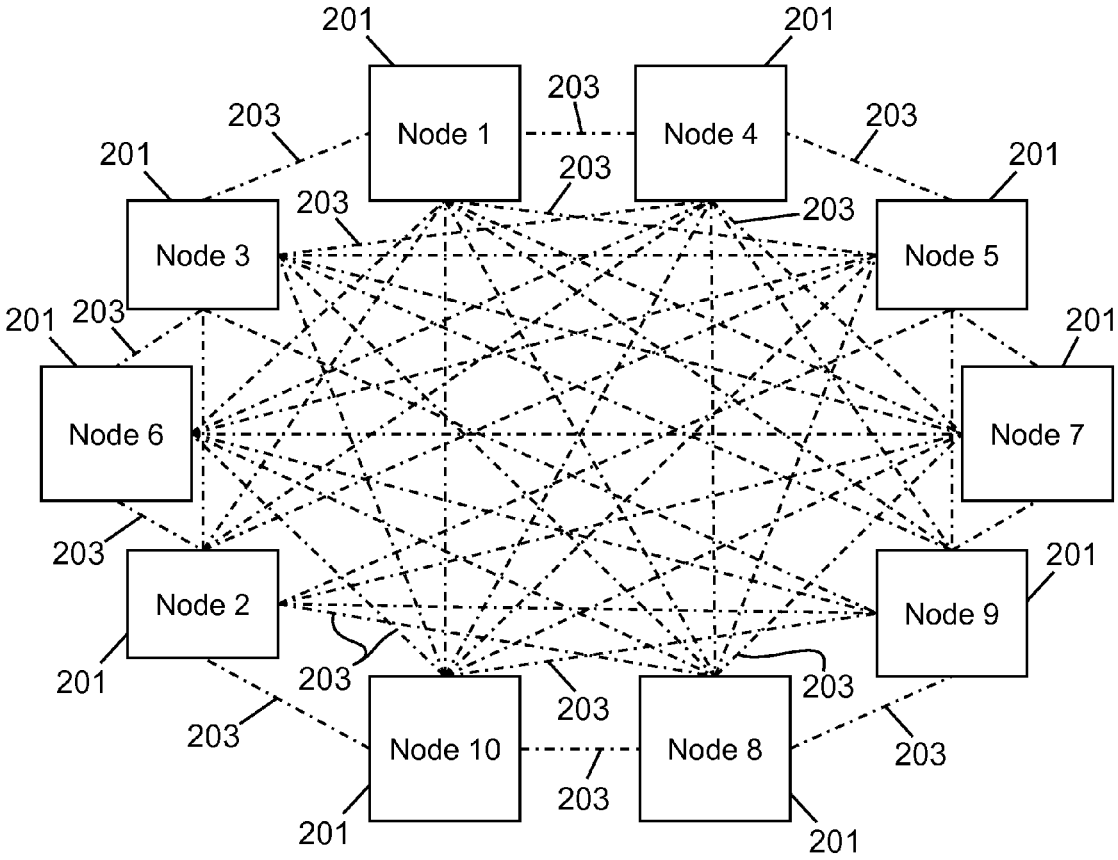
FIG. 6 is an example calculated difference network showing the nodes for the multiple signals ($\Delta(m/z)$) for Betaxolol.

An example of the generation of a list of candidate ion species formed from the specific compound Betaxolol ($C_{18}H_{29}NO_3$) (noted as R in the following chemical formulas) is shown in Table 2 below. The structure of the Betaxolol molecule is shown in FIG. 5. The monoisotopic mass of the molecule is 307.21474 a.u. The theoretical difference network can be graphically depicted as shown in FIG. 6 using Betaxolol as an example. Each entry in graphically represented as a "node" 201 in the difference network diagram shown in FIG. 5. Each one of the nodes (Node 1 through Node 10 in this example) represents the m/z value that would be observed in the mass spectrum if the respective species were detected. The connecting lines 203 between nodes in the network represent the differences in observed m/z between the two species. Each node 201 of FIG. 6 is connected to every other node by a single such line 203. The interconnection of the nodes in this fashion is a representation that, for every candidate ion species, a difference is calculated between the m/z value of the ion species (represented by one of the nodes) and the respective m/z value of every other ion species (represented by the other nodes).

TABLE 2

Selected candidate ion species of betaxolol and its polymers.

| Node ID | Ion Formula | m/z |
|---|---|---|
| 1 | $(R + H)^+$ | 308.22202 |
| 2 | $(R + Na)^+$ | 330.20396 |
| 3 | $(R + NH_4)^+$ | 325.24857 |
| 4 | $(R + K + H_2O)^+$ | 264.18847 |
| 5 | $(R + 2H)^{2+}$ | 154.61465 |
| 6 | $(R + H + Na + H_2O)^{2+}$ | 174.62281 |
| 7 | $(2R + H)^+$ | 614.42894 |
| 8 | $(2R + Na + H_2O)^{2+}$ | 655.45307 |
| 9 | $(2R + Na + H)^{2+}$ | 319.21299 |
| 10 | $(2R + Na + H + H_2O + ACN)^{2+}$ | 348.73165 |
| ... | ... | ... |

Using the data of Table 2, the table of differences as shown in Table 3 is generated (step 154*b* of method 100 shown in FIG. 3) for later comparison (step 156) to the m/z differences determined for the experimental mass spectrum.

TABLE 3

Calculated theoretical difference table for ion species of betaxolol.

| Edge | m/z difference to search in spectrum |
|---|---|
| Node 10-Node 1 | 40.50963 |
| Node 9-Node 1 | 10.99097 |
| Node 8-Node 1 | 347.23105 |

TABLE 3-continued

Calculated theoretical difference table for ion species of betaxolol.

| Edge | m/z difference to search in spectrum |
|---|---|
| Node 7-Node 1 | 306.20692 |
| Node 6-Node 1 | −133.59921 |
| Node 5-Node 1 | −153.60737 |
| Node 4-Node 1 | −44.03355 |
| Node 3-Node 1 | 17.02655 |
| Node 2-Node 1 | 21.98194 |
| Node 10-Node 2 | 18.52769 |
| Node 9-Node 2 | −10.99097 |
| Node 8-Node 2 | 325.24911 |
| . . . | . . . |

Once a candidate-ion-species table is created, as above, the subsequent spectrum analysis may be facilitated by sorting the theoretical difference table and the mass spectral difference table by m/z (optional step 155 of method 100). The mass difference for the species of interest is defined by the following equation:

$$\Delta(m/z)=(n_1m_1+m_{a1}+m_{cc1})/z_1-(n_2m_2+m_{a2}+m_{cc2})/Z_2 \quad \text{Eq. 1}$$

in which Δ(m/z) is the difference in mass-to-charge ratios between two different species of the same molecule; $n_1$ and $n_2$ are the polymeric numbers for the base molecules, $M_1$ and $M_2$, respectively; $m_1$ and $m_2$ are the parent neutral-molecule masses of the base molecules, $M_1$ and $M_2$, respectively; $m_a$ is the total mass that is contributed to the species by the adduct or adducts; $m_{cc}$ is the total mass that is contributed to the species by the charge carrier or carriers; and $z_1$ and $z_2$ are the total charges, respectively on the molecules $M_1$ and $M_2$.

If the assumption is made that the parent molecule, M, is the same for both species (that is, let $M_2 \equiv M_1 \equiv M$ and, consequently, $m_2=m_1$), then the difference, Δ(m/z), is caused only by differences in charge state, adduct(s), and polymer number. Furthermore, the equation can be simplified by assuming that the various difference calculations are to be made only with reference to either $MH^+$ for positive ions or $M-H^-$ for negative ions. For the positive ion case, the equation becomes:

$$\Delta(m/z)=(n_1m_1+m_{a1}+m_{cc1})/z_1-m_1+1.00727 \quad \text{Eq. 2}$$

Still making the assumption that $M_2 \equiv M_1 \equiv M$, the parent mass $m_1$ can be determined by rearranging Eq. 1 to form Eq. 3 (below) and comparing the values supplied by the mass spectrum (for Δm/z) to the total mass difference entries in the table of candidate ion species (e.g., see Table 1 above and further discussion in Section 2.2 below).

$$m_1 = \frac{\Delta(m/z) - (m_{a1} + m_{cc1})/z_1 + (m_{a1} + m_{cc1})/z_2}{(n_1/z_1) - (n_2/z_2)} \quad \text{Eq. 3}$$

The assumption, as stated above, that $M_2 \equiv M_1 \equiv M$ can be verified by comparing the chromatographic peak shapes and retention times for the two species. Whereas the chemistry and physics that determine the chromatographic retention time and peak shape of a particular molecule cease when the molecule exits a chromatographic column, the formation of adducts, protonated molecules, etc. occurs in an ionization chamber after elution has occurred. Thus, all of the various ion species generated from the molecule inherit the chromatic profile of the molecule itself. Eq. 3 is the most complicated method for finding $m_1$. The calculations are simplified if one of the species is determined to be single charged and monomeric.

2.3. Comparing Difference Network to Table of Adducted Species to Generate Frequency Table Each of the nodes 201 in the theoretical difference network may be used to tentatively assign one or more adduct identities to mass spectral peaks within the mass spectrum by correlating the differences in the theoretical difference table (these differences represented by a line or an edge 203 in the graphical representation of the network illustrated in FIG. 5) to the m/z differences, Δm/z, in the mass spectral difference table. In practice, the entries in the mass spectral difference table may be compared, essentially simultaneously, to entries in several theoretical difference tables, where each such mass spectral difference table represents ion species expected to be formed from a different respective analyte molecule. Such simultaneous comparisons enable more than one analyte to be identified in any particular mass spectrum.

Figure 4:
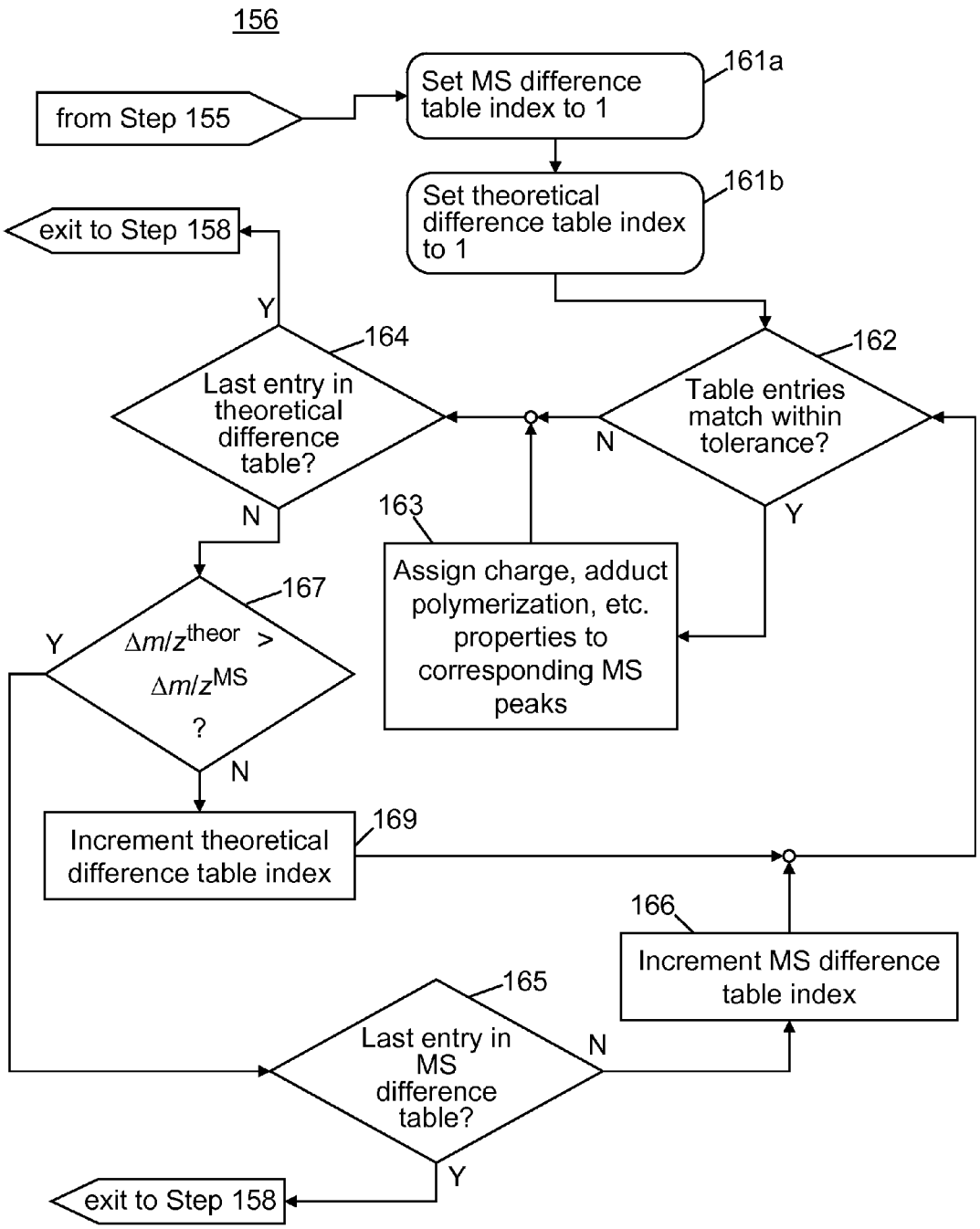
FIG. 4 is a flow diagram of a method in accordance with the present teachings.

The method of making a comparison or comparisons between table entries (step 156 of method 150) is illustrated in greater detail in FIG. 4. The comparison or comparisons may be performed by stepping, in order, through the m/z-sorted entries of a theoretical difference table and, at each such step, searching for a match (in Δm/z) within a mass spectral difference table. The details of the table-entry comparison, as they are outlined in FIG. 4, assume that the entries of both the mass spectral difference table and the theoretical difference table are sorted according to increasing Δm/z values. Let the mass spectral difference table contain a total of J such sorted entries, $r_j$, referenced by the index variable, j, where $1 \le j \le J$. Further, let the theoretical difference table contain a total of K such sorted entries, $s_k$, referenced by the index variable, k, where $1 \le k \le K$. Generally, the two tables may be considered to be databases (or separate sections of a database) and the indexed entries $r_j$ and $s_k$ may be considered to comprise records within the database or databases.

Each entry (or record) of the mass spectral difference table will generally include information pertaining to the m/z values of two mass spectral peaks corresponding to the Δm/z value (or field) of the table entry (or record). Let the Δm/z value that is recorded in $j^{th}$ entry of the mass spectral difference table be denoted as $(\Delta m/z)_j^{MS}$ and, likewise, let the Δm/z value that is recorded in $k^{th}$ entry of the theoretical spectral difference table be denoted as $(\Delta m/z)_k^{theor}$. Each entry (or record) of the theoretical difference table will generally also include information pertaining to the charge, adducts and polymer state of two ionic species. One hypothetical example of the entries of a theoretical difference table is shown in Table 1 herein above.

At the commencement of step 156 just subsequent to step 155 (FIG. 4), the indices j and k are initially set to unity in steps 161*a* and 161*b*, respectively. The corresponding indexed theor entries, $(\Delta m/z)_j^{MS}$ and $(\Delta m/z)_k^{theor}$ (initially $(\Delta m/z)_1^{MS}$ and $(\Delta m/z)_1^{theor}$), are then compared to one another in the decision step 162. A match between table entries may be recognized when the entries agree within a certain tolerance. In many cases, the tolerance may be simply related to the mass spectral resolution, δ, of the instrument used to obtain the spectra, such as for example setting the Tolerance to $\sqrt{2}\delta$. In other situations, the tolerance may be formulated so as to take into account possible uncertainty in the calculation of monoisotopic m/z values. In still other cases, the tolerance may be a pre-determined value or may be input by a user. When a match is recognized (the "Y" exit branch of decision step 162), each of two different ion species is assigned to a respective peak in the mass spectrum in the assignment step 163. The two assigned ion species correspond to (see FIG. 5) the nodes that are connected by the line or edge that corresponds to the matched Δm/z value in the theoretical difference table. Because each adducted species assignment contains information on charge, adducts and polymer state all three of these characteristics are assigned to each one of two mass spectral peaks in step 163. If, in step 162, it is found that the table entries do not match, then the "N" branch of step 162 is followed whereby the assignment step 163 is bypassed. If, in step 164, the final entry in the theoretical difference table has already been reached and considered, then the "Y" branch of step 164 is followed such that execution returns to either optional step 158 or step 159 (FIG. 3). Otherwise, execution proceeds to step 167 in FIG. 4.

Step 167 is a decision step in which the current value of $(\Delta m/z)_k^{theor}$ is compared to the current value of $(\Delta m/z)_j^{MS}$. If the current value of $(\Delta m/z)_k^{theor}$ is greater than the current value of $(\Delta m/z)_j^{MS}$ at step 167, then the "Y" branch of decision step 167 is followed, thereby bypassing the incrementing of index, k, of the theoretical difference table which would otherwise occur in step 169. Instead, the execution of the "Y" branch of step 167 causes the index, j, of the mass spectral difference table to be incremented in step 166, provided that the index j has not already reached its maximum value (i.e., the last record in the mass spectral difference table has been considered), as is determined in step 165. If, at step 167, the current value of $(\Delta m/z)_k^{theor}$ is less than or equal to the current value of $(\Delta m/z)_j^{MS}$, then the "N" branch of step 167 is followed, thereby causing the incrementing of the index, k, of the theoretical difference table in step 169 and bypassing the incrementing of the index j. After the incrementing of either the index k (in step 169) or, alternatively, the index j (in step 166), the step 162 is once again executed to perform a comparison between the new value of one of $(\Delta m/z)_k^{theor}$ and $(\Delta m/z)_j^{MS}$ and the unchanged value of the other one of these quantities. The repetition of step 162 and subsequent steps continues until all of the records have been considered in at least one of the mass spectral difference table and the theoretical difference table. Once a final record has been reached, then execution returns to step 158 or step 159 (FIG. 3) from either step 164 or step 165.

2.4. Confirmation of Tentative Assignments of Species

In cases where there are multiple tentative assignments of different species to a particular mass spectral peak (i.e., an m/z value in the mass spectrum), the assignment with the highest frequency may be chosen while alternative assignments are discarded in optional step 158 of the method 150 (FIG. 3). Because each adducted species assignment contains information on charge, adducts and polymer state all three of these characteristics are assigned to each mass spectral peak. Ambiguities in the assignments can be resolved by addition additional constraints (if known). Such constraints may include, for example, (a) the degree of retention time alignment between the detected chromatographic peaks that match each of the nodes and (b) the degree of peak shape similarity between the detected chromatographic peaks that match each of the nodes. The constraints may be implemented as weighting factors. The weighting factors can be node specific, which causes edges to move up or down on the ordered list of nodes (e.g., see FIG. 6 and Table 2). The final assignments may then be made according to the final position in the ordered list. Should ambiguities still arise, all possibilities may be reported.

Finally, initial steps 159*a* and 159*b* represent two alternative but not mutually exclusive means for using the ion species assignments that result from the execution of the method 150. In step 159*a*, the results are stored (for example, to electronic data storage device 36 illustrated in FIG. 1), or otherwise reported to a user (for example through the output or display device 38). The stored results may be used at a later time by either a user or by an automatic processor in order to identify the presence or quantities of various analyte molecules in a sample or to analyze post-ionization adduction reaction mechanisms or kinetics.

In step 159*b*, which could be employed in addition to step 159*a*, the ion species assignment results are used, in a data-dependent fashion, so as to further control operation of the mass spectrometer 34 (FIG. 1) that is operating simultaneously with the execution of the method 150 by the programmable processor 37. In but one example of such data-dependent operation, the ion species assignment results may be employed to choose a particular mass spectral peak for isolating a precursor ion for subsequent tandem mass spectrometry. As mentioned previously, the existence of many possible adducts, charge states, and states of polymerization can lead to the existence of many closely spaced or overlapping mass spectral peaks. For purposes of tandem mass spectrometry, particular precursor ion species are required to be isolated for subsequent fragmentation or other ion reaction so as to analyze particular fragment or product ion species. The existence of many mass spectral peaks from multiple adducts, charge states, and polymerization states can lead to potential confusion in the recognition of the appropriate precursor ion species, especially if ions from many eluate molecules are present in a mass spectrum. The assignment of multiple specific species identifications, as disclosed herein, can provide the capability to distinguish mass spectral peaks of interest from interfering peaks of no analytical interest. In some cases, the species assignments may be employed to choose, for subsequent isolation and fragmentation, among several alternative precursor ion species that are all diagnostic of the same analyte molecule.

Methods in accordance with the present teachings may be employed to assign charge states (such as protonation states), neutral adducts, in-source neutral losses, and polymerization states and combinations thereof to mass spectral data. The complexity of the mass spectral information is reduced as a consequence of identification of the aforementioned species, which provides the analyst the capability to group compound related signals. The accuracy of the methods taught herein may be further enhanced by incorporation of information such as mobile phase composition and knowledge of in-source fragmentation. Preference can be given to species known to occur through the use of weighting factors for the predicted adducts, charge carriers, and neutral loss species. The inventors have also determined that uncommon adducts such as those containing calcium, magnesium, and iron may be identified and reported by employing the methods of the present teachings.

The discussion included in this application is intended to serve as a basic description. Although the invention has been described in accordance with the various embodiments shown and described, one of ordinary skill in the art will readily recognize that there could be variations to the embodiments and those variations would be within the spirit and scope of the present invention. The reader should be aware that the specific discussion may not explicitly describe all embodiments possible; many alternatives are implicit. For example, the step 155 of sorting the list entries in accordance with monoisotopic m/z values could comprise sorting by either increasing m/z value or decreasing m/z value. Similarly, the steps 161*a*, 161*b* of setting table indices to their minimum values (unity) and correspondingly the steps 166, 167 of incrementing table indices could be simultaneously replaced by first setting the indices to the respective maximum values and then progressively decrementing the indices. This change represents an obvious modification of simply searching through the MS difference table and the theoretical difference table oppositely to the order that is explicitly described in the text, which modification obviously does not change the final results or produce any particular advantage or disadvantage. Accordingly, many such obvious modifications may be made by one of ordinary skill in the art without departing from the scope and essence of the invention. All such modifications are contemplated the present disclosure. Neither the description nor the terminology is intended to limit the scope of the invention. Any patents, patent applications, patent application publications or other literature mentioned herein are hereby incorporated by reference herein in their respective entirety as if fully set forth herein.

What is claimed is:

1. A mass spectrometric analysis method comprising:

(a) identifying isotopic clusters in experimentally observed mass spectral data;

(b) determining a respective experimental monoisotopic mass-to-charge (m/z) value for each identified isotopic cluster;

(c) calculating theoretical monoisotopic m/z values of a plurality of ion species theoretically predicted to be generated by mass spectral ionization of analyte molecules, each ion species corresponding to a respective combination of analyte-molecule composition, adduction, ionic charge state, and analyte-molecule polymerization state;

(d) calculating an m/z-value difference, $\Delta(m/z)_{exp}$, corresponding to the difference between the m/z values of each respective pair of determined experimental monoisotopic m/z values;

(e) calculating an m/z-value difference, $\Delta(m/z)_{theor}$, corresponding to the difference between the m/z values of each respective pair of calculated theoretical monoisotopic m/z values;

(f) assigning, to the respective pair of ion species corresponding to each pair of experimental monoisotopic m/z values for which $\Delta(m/z)_{exp}$ is equal to a matching $\Delta(m/z)_{theor}$ within a predetermined tolerance, the combinations of adduction, ionic charge state, and analyte-molecule polymerization state corresponding to the pair of theoretically-predicted ion species corresponding to the matching $\Delta(m/z)_{theor}$; and (g) storing or reporting to a user the results of the assigning.

2. A mass spectrometric analysis method as recited in claim 1, further comprising:

receiving, from a mass spectrometer, the experimentally observed mass spectral data prior to performing the step (a) identifying isotopic clusters;

choosing an ion species for further fragmentation or reaction in the mass spectrometer, wherein the choice of ion species is based on the assigning; and performing the fragmentation or reaction on the chosen ion species in the mass spectrometer.

3. A mass spectrometric analysis method as recited in claim 1, further comprising, prior to the step (g) of storing or reporting:

for each ion species corresponding to a determined experimental monoisotopic ink value, tabulating the total number of times that each combination of adduction, ionic charge state, and analyte-molecule polymerization state has been assigned to the ion species; and choosing, as a final assignment for each ion species, the particular combination of adduction, ionic charge state, and analyte-molecule polymerization state that has been assigned to the respective ion species the greatest number of times.

4. A mass spectrometric analysis method as recited in claim 3, further comprising:

receiving, from a mass spectrometer, the experimentally observed mass spectral data prior to performing the step (a) identifying isotopic clusters;

choosing an ion species for further fragmentation or reaction in the mass spectrometer, wherein the choice of ion species is based on the assigning; and performing the further fragmentation or reaction on the chosen ion species in the mass spectrometer.

5. A mass spectrometric analysis method as recited in claim 1, further comprising:

identifying the presence or absence, in a sample, of one or more analyte molecules, the ionization of which generated the experimentally observed mass spectral data based on the assigning; and storing or reporting to a user the identification of the presence or absence, in the sample, of the one or more analyte molecules.

6. A mass spectrometric analysis method as recited in claim 1, further comprising, after the steps (d) and (e) of calculating $\Delta(m/z)_{exp}$ and $\Delta(m/z)_{theor}$, and prior to the assigning step (f), the further steps of:

sorting a table of records containing the $\Delta(m/z)_{exp}$ values in order of $\Delta(m/z)_{exp}$;

sorting another table of records containing the $\Delta(m/z)_{theor}$ values in order of $\Delta(m/z)_{theor}$.

7. A mass analysis system comprising:

(i) a sample source;

(ii) a mass spectrometer configured to receive a sample from the sample source and comprising:

an ion source configured to ionize molecules of the received sample so as to generate a plurality of ion species;

a mass analyzer configured to receive the ion species and separate the ion species in accordance with their respective mass-to-charge (m/z) ratios; and a detector configured to detect the separated ion species;

(iii) a programmable processor electrically coupled to the mass spectrometer and configured to control operation of the mass spectrometer and to receive mass spectral data therefrom; and (iv) at least one output device electrically coupled to the programmable processor, wherein the programmable processor comprises program instructions operable to cause the programmable processor to:

(a) identify isotopic clusters in the received mass spectral data;

(b) determine a respective experimental monoisotopic mass-to-charge (m/z) value for each identified isotopic cluster;

(c) calculate theoretical monoisotopic m/z values of a plurality of ion species theoretically predicted to be generated by mass spectral ionization of analyte molecules, each ion species corresponding to a respective combination of analyte-molecule composition, adduction, ionic charge state, and analyte-molecule polymerization state;

(d) calculate an m/z-value difference, $\Delta(m/z)_{exp}$, corresponding to the difference between the m/z values of each respective pair of determined experimental monoisotopic m/z values;

(e) calculate an m/z-value difference, $\Delta(m/z)_{theor}$, corresponding to the difference between the m/z values of each respective pair of calculated theoretical monoisotopic m/z values; and (f) assign, to the respective pair of ion species corresponding to each pair of experimental monoisotopic m/z values for which $\Delta(m/z)_{exp}$ is equal to a matching $\Delta(m/z)_{theor}$ within a predetermined tolerance, the combinations of adduction, ionic charge state, and analyte-molecule polymerization state corresponding to the pair of theoretically-predicted ion species corresponding to the matching $\Delta(m/z)_{theor}$; and (g) output the results of the assigning to the at least one output device.

8. The mass analysis system of claim 7, wherein the programmable processor comprises further program instructions operable to cause the programmable processor further to:

choose an ion species for further fragmentation or reaction in the mass spectrometer, based on the assigning; and cause the mass spectrometer to fragment or to cause reaction of the chosen ion species in the mass spectrometer.

* * * * *

UNITED STATES PATENT AND TRADEMARK OFFICE

CERTIFICATE OF CORRECTION

PATENT NO. : 9,159,538 B1
APPLICATION NO. : 14/302304
DATED : October 13, 2015
INVENTOR(S) : McClure et al.

It is certified that error appears in the above-identified patent and that said Letters Patent is hereby corrected as shown below:

Claims
Claim 3, column 13, line 59:
replace "monoisotopic ink value"
with --monoisotopic m/z value--

Signed and Sealed this
Fifth Day of April, 2016

Michelle K. Lee

Michelle K. Lee
*Director of the United States Patent and Trademark Office*